United States Patent [19]

May et al.

[11] 4,196,708

[45] Apr. 8, 1980

[54] ENGINE SYSTEMS

[75] Inventors: William S. May, High Wycombe; Christopher H. Best, West Sunbury, both of England

[73] Assignee: Lucas Industries Limited, Birmingham, England

[21] Appl. No.: 958,543

[22] Filed: Nov. 8, 1978

[30] Foreign Application Priority Data

Dec. 1, 1977 [GB] United Kingdom ..... 50166/77

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 1,933,619 | 11/1933 | Edwards | 123/119 A |
| 2,456,213 | 12/1948 | Pelc | 123/119 A |
| 3,135,253 | 6/1964 | Muhlberg | 123/119 A |
| 3,915,134 | 10/1975 | Young et al. | 123/119 A |
| 3,916,857 | 11/1975 | Naito et al. | 123/119 A |
| 4,020,809 | 5/1977 | Kern et al. | 123/119 A |
| 4,031,873 | 6/1977 | Banzhaf et al. | 123/119 |
| 4,043,304 | 8/1977 | Stumpp et al. | 123/119 A |
| 4,075,994 | 2/1978 | Mayer et al. | 123/119 A |
| 4,085,718 | 4/1978 | Schaal | 123/119 A |
| 4,109,625 | 8/1978 | Kawamura et al. | 123/119 A |

*Primary Examiner*—Wendell E. Burns

[57] ABSTRACT

An engine system includes a valve operable to permit exhaust gas to flow from the exhaust manifold to the air inlet manifold of an engine for the purpose of reducing the noxious gas content of the exhaust. The setting of the valve is dependent upon the amount of fuel supplied to the engine by the pump. A hydraulic signal is generated and this is derived from a supply pump by way of a fixed orifice this pressure being applied to a control valve which regulates the pressure applied to an actuator including a spring loaded piston. A throttle which controls the amount of fuel delivered by the injection pump also forms a further adjustable orifice downstream of the orifice whereby the pressure downstream of the orifice is dependent upon the amount of fuel supplied to the engine.

5 Claims, 2 Drawing Figures

ENGINE SYSTEMS

This invention relates to an engine system of the kind including a diesel engine having an inlet manifold and an exhaust manifold, a fuel pump for supplying fuel to the engine in timed relationship therewith, and a valve operable to permit exhaust gases to flow to the air inlet manifold.

Exhaust gas recirculation is known to be beneficial in reducing the emission of noxious gases from the engine exhaust. The amount of exhaust gas which is circulated should be dependent upon the load on the engine with the amount decreasing as the load on the engine increases.

The object of the invention is to provide such a system in a simple and convenient form.

According to the invention an engine system of the kind specified comprises an actuator, linkage means connecting said actuator with said valve, resilient means biasing the valve to the closed position, said fuel pump including an injection pump, a feed pump for supplying fuel to the injection pump, an adjustable throttle for controlling the rate of supply of fuel to the injection pump, a variable orifice controlled by the throttle, a fixed orifice disposed intermediate the feed pump and the variable orifice, a control surface incorporated in said actuator, a passage through which a fluid pressure can be applied to said control surface to effect opening of said valve, and a control valve in said passage, said control valve being responsive to the pressure intermediate said orifices and acting to control the pressure pressure applied to said surface so that it varies in accordance with the quantity of fuel which is supplied to the engine whereby the amount of exhaust gas supplied to the air inlet manifold decreases as the amount of fuel supplied to the engine increases.

Figure 1:
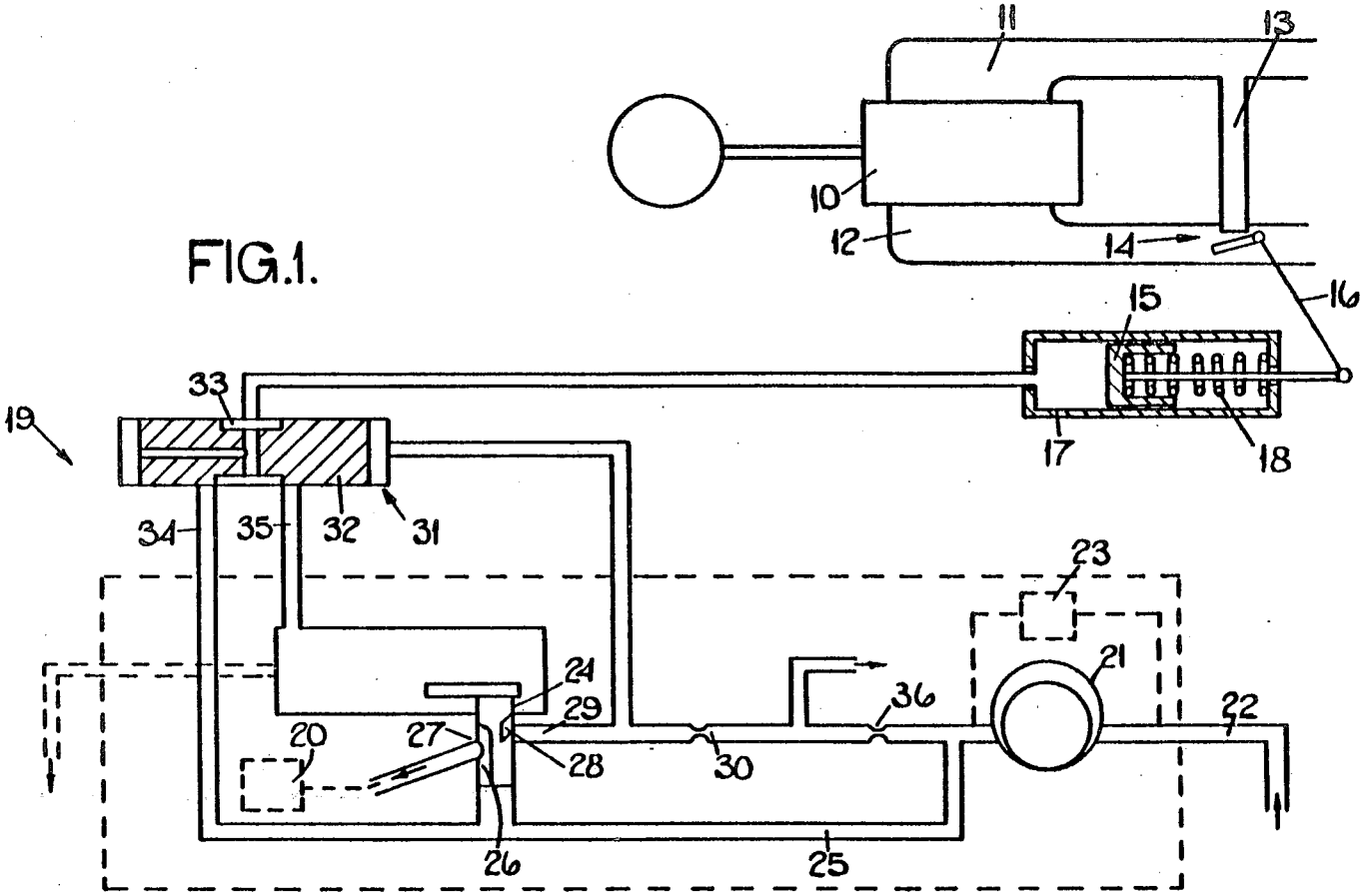
FIG. 1 is a layout of one example of a system in accordance with the invention.

Referring to FIG. 1 of the drawings, a diesel engine is indicated at 10 and has an exhaust manifold 11 and an air inlet manifold 12. A conduit 13 connects at one end with the exhaust manifold and leads into the air inlet manifold. A valve generally indicated at 14 is provided for controlling the amount of exhaust gas which flows into the air inlet manifold. An actuator in the form of a piston 15 slidably mounted in a cylinder 17 is provided and is connected to the valve member of the valve 14 by means of linkage 16. The piston is biased by a coiled compression spring 18 to a position in which the valve 14 is closed.

Fuel is supplied to the engine by a pump which is generally indicated at 19. The pump includes an injection pump and distributor member 20 which supply fuel to the injection nozzles of the engine in timed relationship with the operation of the engine. Fuel is supplied to the injection pump by means of a feed pump 21 which has a fuel inlet 22. The flow of fuel to the injection pump is controlled by a throttle valve which is generally indicated at 24. The fuel flowing to the engine by way of the throttle valve flows by way of a passage 25 and the throttle valve is angularly adjustable and has a longitudinal groove 26 which registers with a port 27 communicating with the injection pump. The setting of the throttle valve is determined by a governor mechanism not shown, but this is responsive to the speed of operation of the engine whereby with increasing speed the amount of fuel which is supplied to the engine is decreased. The governor mechanism also includes an operator adjustable member whereby the speed of the engine can be controlled.

The outlet pressure of the feed pump is controlled by a relief valve, 23 and the throttle valve 24 also forms a variable orifice which is constituted by a helically disposed groove 28 which is formed on the throttle valve and which is in constant but variable communication with a port 29 which communicates with the outlet of the feed pump by way of a fixed orifice 30. The groove 28 permits a flow of fuel to a drain, the amount of fuel flowing depending upon the angular position of the throttle valve. Conveniently, the fuel flowing through the groove 28 flows to an internal cavity in the pump 19 and is returned to the fuel inlet of the feed pump. The pressure of fuel intermediate the orifices decreases as the amount of fuel supplied to the injection pump increases.

Also provided is a control valve which is indicated at 31 and this comprises a piston 32 movable within a cylinder. One end of the cylinder is connected to a point intermediate the two orifices. The piston 32 is provided with a circumferential groove 33 which is in communication with the other end of the cylinder by way of an axial drilling in the piston 32. The groove 33 is in constant communication with the cylinder 17 which contains the actuator piston 15. A pair of ports 34, 35 are formed in the wall of the cylinder which accommodates the piston 32 and the port 35 which is the one which lies closest to the end of the cylinder which is connected to the point intermediate the two orifices, is connected to a drain. The port 34 is connected to the outlet of the feed pump. The spacing of the ports 34, 35 is substantially equal to the width of the circumferential groove 33. In operation, as the pressure between the two orifices varies the piston 32 will move to control the pressure applied to the piston 15 so that it equals the pressure between the two orifices. The pressure however, for actuating the piston 15 is derived directly from the outlet of the feed pump. The arrangement of the system is such that as the throttle valve is moved to increase the quantity of fuel supplied to the engine which indicates an increased load on the engine, the pressure applied to the piston 15 is decreased and the valve 14 is moved to reduce the amount of exhaust gas supplied to the air inlet manifold. Conversely, when the throttle valve is moved to reduce the amount of fuel supplied to the engine, the pressure applied to the piston 15 increases and more exhaust gas is supplied to the air inlet manifold.

The injection pump 20 will normally incorporate means for varying the timing of injection of fuel to the engine in accordance with the speed of the engine and the load on the engine. A pressure signal for actuating the aforesaid means can be obtained by providing a further fixed orifice 36 intermediate the outlet of the feed pump and the orifice 30. The relief valve 23 which controls the outlet pressure of the feed pump does so in a manner so that the outlet pressure varies in accordance with the speed of the associated engine that is to say it increases as the engine speed increases.

By varying the size of the orifice 30 and the variable orifice, any suitable load/speed characteristics can be obtained for controlling the amount of exhaust gas which is supplied to the air inlet manifold.

Figure 2:
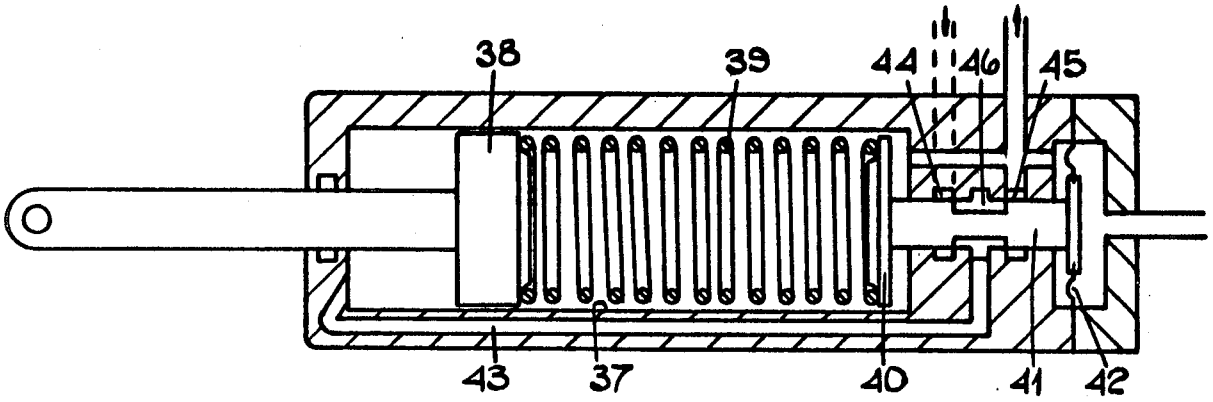
FIG. 2 is a modification to part of the system shown in FIG. 1.

In FIG. 2 the actuator is combined with the control valve 31. With reference to FIG. 2 a cylinder 37 houses a piston 38 connected by linkage to the valve 14. The piston is biased by a coiled compression spring 39 which bears against an abutment plate 40. The abutment plate is mounted at the end of the cylindrical valve member 41 e.g. the control valve and the other end of the valve member 41 is connected to a diaphragm 42. A control signal input leads into a chamber defined in part by the side of the diaphragm remote from the valve member, the chamber defined on the other side of the diaphragm being connected to a chain.

The valve member 41 is located in a bore into which leads a passage 43, the end of the passage being in constant communication with a groove 46 on the valve member. The other end of the passage 43 communicates with the end of the cylinder remote from the piston. The bore in which the valve member 41 is located has a pair of ports 44, 45 therein and these are positioned on opposite sides of the end of the passage 43. The port 44 in use communicates with a source of fluid under pressure for example the outlet of the feed pump or the lubrication system of the associated engine and the port 45 communicates with a drain. The spacing of the ports 44, 45 is substantially equal to the width of the groove 46 and in use when the control pressure increases the valve member 41 is initially moved to the left as seen in FIG. 2, to allow liquid under pressure to flow through the port 44, the groove 46 and the passage 43 to act on the piston. The piston is moved by the liquid under pressure against the action of the spring and the force exerted by the spring is increased thereby tending to restore the valve member to its original position. When the control pressure is decreased the valve member moves to the right as liquid can escape from the cylinder through the port 45, the valve member once more moving towards the original or equilibrium position in which it is shown in the drawing.

We claim:

1. An engine system including a diesel engine having an inlet manifold and an exhaust manifold, a fuel pump for supplying fuel to the engine in timed relationship therewith, and a valve operable to permit exhaust gases to flow to the air inlet manifold, an actuator, linkage means connecting said actuator with said valve, resilient means biasing the valve to the closed position, said fuel pump including an injection pump, a feed pump for supplying fuel to the injection pump, an adjustable throttle for controlling the rate of supply of fuel to the injection pump, a variable orifice controlled by the throttle, a fixed orifice disposed intermediate the feed pump and the variable orifice, a control surface incorporated in said actuator, a passage through which a fluid pressure can be applied to said control surface to effect opening of said valve, and a control valve in said passage, said control valve being responsive to the pressure intermediate said orifices and acting to control the pressure applied to said surface so that it varies in accordance with the quantity of fuel which is supplied to the engine whereby the amount of exhaust gas supplied to the air inlet manifold decreases as the amount of fuel supplied to the engine increases.

2. A system according to claim 1 in which said control valve includes a valve member to one end of which is applied a force dependent upon the value of said control pressure, and to the other end of which is applied a force dependent upon the fluid pressure applied to said control surface, the two forces acting in opposition.

3. A system according to claim 2 in which the valve member is subjected at one end to the control pressure and at its other end to the pressure applied to said control surface.

4. A system according to claim 2 in which one end of the valve member is connected to a diaphragm the face of which remote from the valve member is subject to said control pressure, the other end of the valve member being connected to an abutment for said resilient means whereby as the liquid pressure applied to the control surface is increased, the force applied to said other end of the valve member is increased and vice versa.

5. A system according to claim 4 in which said resilient means comprises a coiled compression spring which is interposed between said abutment and said control surface.

* * * * *